US011845089B2

(12) United States Patent
Jackson et al.

(10) Patent No.: US 11,845,089 B2
(45) Date of Patent: Dec. 19, 2023

(54) MAGNETIC DRAWER SEPARATOR

(71) Applicant: Bunting Magnetics Co., Newton, KS (US)

(72) Inventors: Joseph A. Jackson, Wichita, KS (US); Donald A. Suderman, Newton, KS (US); Marc A. Suderman, Park City, KS (US)

(73) Assignee: Bunting Magnetics Co., Newton, KS (US)

( * ) Notice: Subject to any disclaimer, the term of this patent is extended or adjusted under 35 U.S.C. 154(b) by 63 days.

(21) Appl. No.: 17/840,094

(22) Filed: Jun. 14, 2022

(65) Prior Publication Data

US 2022/0305499 A1 Sep. 29, 2022

(51) Int. Cl.

| | |
|---|---|
| ***B03C 1/033*** | (2006.01) |
| ***B03C 1/032*** | (2006.01) |
| ***B03C 1/26*** | (2006.01) |

(52) U.S. Cl.

CPC ..... *B03C 1/0332* (2013.01); *B03C 1/032* (2013.01); *B03C 1/26* (2013.01); *B03C 2201/20* (2013.01)

(58) Field of Classification Search

CPC ..... B03C 1/0332; B03C 1/032; B03C 1/26; B03C 2201/20; B03C 2201/22; B03C 1/288; B03C 1/284

(Continued)

(56) References Cited

U.S. PATENT DOCUMENTS 3,394,807 A 7/1968 Fritz et al.
4,333,825 A * 6/1982 Wyland ..... B03C 1/284 209/231

(Continued)

FOREIGN PATENT DOCUMENTS

CN 201783391 4/2011
CN 210999563 7/2020

(Continued)

OTHER PUBLICATIONS

Author: Unknown; "Industrial Magnetics (IMI) Magnets for Ferrous Metal Separation and Extraction in Processing Applications and Conveying Lines" ; Media Type—Internet; Date of search: Mar. 1, 2022; p. No. N/A; vol./Issue #: https://web.archive.org/web/20220224161434/https://www.cmtnc.com/imi-magnets.html; Publisher: CMT, Inc.; City/Country of Publication—U.S.

(Continued)

*Primary Examiner* — Gene O Crawford

*Assistant Examiner* — Muhammad Awais

(74) *Attorney, Agent, or Firm* — Kenneth H. Jack; Davis & Jack, L.L.C.

(57) ABSTRACT

A magnetic drawer separator incorporating at least a first permanent magnet series having a longitudinal, oppositely longitudinal, and outer ends, each permanent magnet having an opening; a longitudinally extending hollow bore within the at least first permanent magnet series, the bore being formed by the permanent magnets' openings; at least a first shaft having longitudinal and oppositely longitudinal ends, the longitudinal end of the at least first shaft engaging the at least first permanent magnet series within the bore; at least a first wiper engaging the outer end of the at least first permanent magnet series; and a frame having longitudinal and oppositely longitudinal ends, wherein the at least first wiper is fixedly attached to the frame's longitudinal end, and wherein the at least first shaft is fixedly attached to the frame's oppositely longitudinal end.

20 Claims, 8 Drawing Sheets

(58) Field of Classification Search
USPC ..... 209/223.2
See application file for complete search history.

(56) References Cited

U.S. PATENT DOCUMENTS

| | | | | | |
|---|---|---|---|---|---|
| 4,457,838 | A * | 7/1984 | Carr | B03C 1/284 | 209/229 |
| 4,750,996 | A * | 6/1988 | Meister | B03C 1/26 | 210/95 |
| 4,867,869 | A * | 9/1989 | Barrett | B03C 1/284 | 312/334.44 |
| 5,043,063 | A * | 8/1991 | Latimer | B03C 1/288 | 210/222 |
| 5,066,390 | A * | 11/1991 | Rhodes | B03C 1/284 | 209/217 |
| 5,188,239 | A * | 2/1993 | Stowe | B03C 1/284 | 209/229 |
| 5,190,159 | A * | 3/1993 | Barker | B03C 1/284 | 209/229 |
| 5,316,151 | A * | 5/1994 | Thompson | B03C 1/284 | 209/223.1 |
| 5,427,249 | A * | 6/1995 | Schaaf | B03C 1/30 | 209/908 |
| 5,819,949 | A * | 10/1998 | Schaaf | B03C 1/284 | 403/321 |
| 5,982,261 | A | 11/1999 | Stowe | | |
| 6,077,333 | A * | 6/2000 | Wolfs | B03C 1/288 | 210/695 |
| 6,250,475 | B1 * | 6/2001 | Kwasniewicz | B03C 1/284 | 209/229 |
| 6,902,066 | B2 * | 6/2005 | Yang | B03C 1/284 | 209/229 |
| 8,132,674 | B1 * | 3/2012 | Allore | B03C 1/0332 | 209/229 |
| 8,360,247 | B2 * | 1/2013 | Baker | B03C 1/286 | 209/229 |
| 8,474,629 | B1 * | 7/2013 | Allore | B03C 1/284 | 209/229 |
| 9,962,710 | B2 | 5/2018 | Suderman | | |
| 10,300,497 | B2 | 5/2019 | Kwasniewicz | | |
| 2010/0055221 | A1 * | 3/2010 | Hein | G03H 1/028 | 425/3 |
| 2012/0175312 | A1 * | 7/2012 | Martin | B03C 1/286 | 210/695 |
| 2018/0056306 | A1 * | 3/2018 | Kwasniewicz | B03C 1/288 | |
| 2018/0078947 | A1 * | 3/2018 | Pallin | B03C 1/0335 | |
| 2019/0046993 | A1 * | 2/2019 | Kwasniewicz | B03C 1/284 | |
| 2020/0047189 | A1 * | 2/2020 | Mackenzie | E21B 21/065 | |
| 2020/0179942 | A1 * | 6/2020 | Chang | B03C 1/288 | |
| 2021/0316315 | A1 * | 10/2021 | Wey | B03C 1/284 | |
| 2021/0339268 | A1 * | 11/2021 | Wey | B03C 1/286 | |
| 2022/0048043 | A1 * | 2/2022 | Wey | B03C 1/26 | |

FOREIGN PATENT DOCUMENTS

| | | |
|---|---|---|
| KR | 102106735 B1 | 5/2020 |
| NL | 84112 | 3/1954 |
| WO | WO2021010840 | 1/2021 |

OTHER PUBLICATIONS

Author: Unknown; "Drawer Magnets for Gravity Flow Applications in All Industries"; Media Type—Internet; Date of search: Mar. 1, 2022; p. No. N/A; vol./Issue #: https://web.archive.org/web/20200508023705/https://buntingmagnetics.com; Publisher: Bunting Magnetics Co.; City/Country of Publication—U.S.

Author: Unknown; "Grate Magnet" ; Media Type—Internet; Date of search: Mar. 1, 2022; p. No. N/A; vol./Issue #: https://web.archive.org/web/20220224162148//https://www.dingsmagnets.com/grate-magnet.html; Publisher: Dings Magnetics Group; City/Country of Publication—U.S.

Author: Unknown; "Quick-Clean Drawer Magnet"; Media Type—Internet; Date of search: Mar. 1, 2022; p. No. N/A; vol./Issue #: https://mpimagnet.com/products/magnetic-separation/gravity-free-flow/drawer/magnets/quick-clean-drawer-maPublisher: Magnetics Products, Inc.; City/Country of Publication—U.S.

Author: Unknown; "Drawer-in-Housing"; Media Type—Internet; Date of Search: Mar. 1, 2022; p. No. N/A; vol./Issue #: https://web.archive.org/web/202107281; Publisher: Industrial Magnetics, Inc.; City/Country of Publication—U.S.

* cited by examiner

MAGNETIC DRAWER SEPARATOR

FIELD OF THE INVENTION

This invention relates to magnetic separators which support cylindrical magnetic cartridges within a conduit which conveys a stream of materials, such materials stream potentially including ferrous contaminants in the from of tramp iron, iron fragments, or debris which is subject to magnetic attraction. As such stream of materials flows over the magnetic cartridges, such ferrous contaminants magnetically adhere to the magnetic cartridges and are thereby removed from the materials stream. More particularly, this invention relates to such magnetic separators which configure their magnetic cartridge elements for insertions into and extractions from the materials stream in the manner of an extendable and retractable drawer.

BACKGROUND OF THE INVENTION

Drawer configured magnetic separators are known to incorporate magnetic cartridges which are configured as telescoping quill and stem combinations. In such known magnetic separators, the quill components comprise non-magnetic outer tubes or sleeves, and the stem components comprise series of permanent magnets which are housed and slidably supported within the non-magnetic quills. Upon accumulation of ferrous debris or tramp iron upon the exterior surfaces of such non-magnetic quills, the internally housed magnetic stems may be forwardly or longitudinally withdrawn from the hollow bores of the non-magnetic quills. Such magnetic stem withdrawals allow magnetically collected tramp iron to be released from the exterior surfaces of the non-magnetic quills, to fall downwardly therefrom.

Utilization of such non-magnetic quills for slidably supporting and housing the interior magnetic stems requires that each quill multiply function as a structural support member, as a magnetic attraction surface, and as a tramp iron releasing member. The quills' performance of the structural support function requires that the quills have wall thicknesses which are sufficient for structural support of the interior magnetic stem components. While increasing the wall of such quill components enables the structural support function, added thickness undesirably decreases magnetic attraction at the outer surface of the quill. Such known non-magnetic quill and magnetic stem configured magnetic separator cartridges undesirably compromise magnetic strength at the outer surface of the quills.

The instant inventive drawer configured magnetic separator solves or ameliorates the drawbacks and deficiencies of the above discussed quill and sleeve configured magnetic separator cartridges by obverting the outer and inner components of the quill and stem combination cartridges to present non-magnetic stems which are slidably received within hollow bored magnetic quills. Such obverted configuration allows tramp iron to be directly magnetically attracted at the outer surface of the combination's magnetic element with little or no alteration of magnetic strength. Interior non-magnetic stem components provide structural support and function as a tramp iron releasing structure. Annular or ring configured wipers are additionally provided for performance with the non-magnetic stems of the tramp iron release function.

BRIEF SUMMARY OF THE INVENTION

A first structural component of the instant inventive magnetic drawer separator comprises a drawer frame having longitudinal end, an oppositely longitudinal ends, an open upper end, and an open lower end. At least a first, and preferably a plurality of quill and stem configured magnetic cartridges, are mounted within the drawer frame, such combinations' stem components being slidably and telescopingly moveable within the hollow bores of the combination's quill components. In a preferred embodiment, each stem component of the quill and stem combinations comprises a non-magnetic arm or cantilevering shaft which is closely fitted for sliding insertions into and extractions from the hollow bore of one of the quill and stem combinations' quill components. Such stem component preferably is composed of non-magnetic stainless steel, and may suitably be alternatively composed of another durable non-magnetic material such as aluminum or brass.

The quill components of the instant invention's quill and stem combinations preferably comprise a longitudinally stacked series of magnetic rings. Each magnetic ring segment of each quill preferably comprises a permanent magnet composed of a ferrite iron oxide and strontium carbonate alloy; an aluminum, nickel, and cobalt (alnico) alloy; a neodymium, iron, boron alloy; or a samarium, cobalt alloy.

In a preferred embodiment, the ring configured permanent magnets are arranged so that adjacent magnets have like poles facing each other (i.e., a . . . N, N, S, S, N, N, S, S, . . . polar arrangement). Also in the preferred embodiment, paramagnetic or mild steel pole pieces are interposed between each of the ring configured permanent magnets for enhancement of magnetic strength at the outer surfaces of the magnetic cartridges.

The drawer frame suitably has a plate or wall configured rearward or oppositely longitudinal end which supports rearward or oppositely longitudinal ends of the quill and stem combinations' stem components. A forward or longitudinal end of the drawer frame is similarly suitably plate or wall configured. Such longitudinal frame end supports a plurality of wiper rings which, in combination with the non-magnetic stems, perform a tramp iron release function. The wiper rings are preferably closely fitted to and extend annularly about the quill and stem combinations' quills.

Pull handles are preferably fixedly attached to the forward or longitudinal ends of the quill and stem combinations' quills, the handles allowing an operator to individually pull the magnetic quills forwardly through the wipers. As the magnetic quill components are slidably forwardly withdrawn from the front of the drawer, the quills slide along and are supported by the non-magnetic stems. Wiping of the outer surfaces of the quills progresses during such pulling operations, the wiping action advantageously screeding accumulated tramp iron oppositely longitudinally along the outer surfaces of the magnetic quills. Such screeded tramp iron falls from the oppositely longitudinal ends of the magnetic quills to fall downwardly over or across the forward ends of the non-magnetic stems. As a beneficial result of the stems' non-magnetic character, they assist in the performance of the magnetic release function.

Accordingly, objects of the instant invention include the provision of a magnetic drawer separator which incorporates structures as described above, and which arranges those structures in relation to each other in manners described above for the performance of and achievement of beneficial functions, as described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
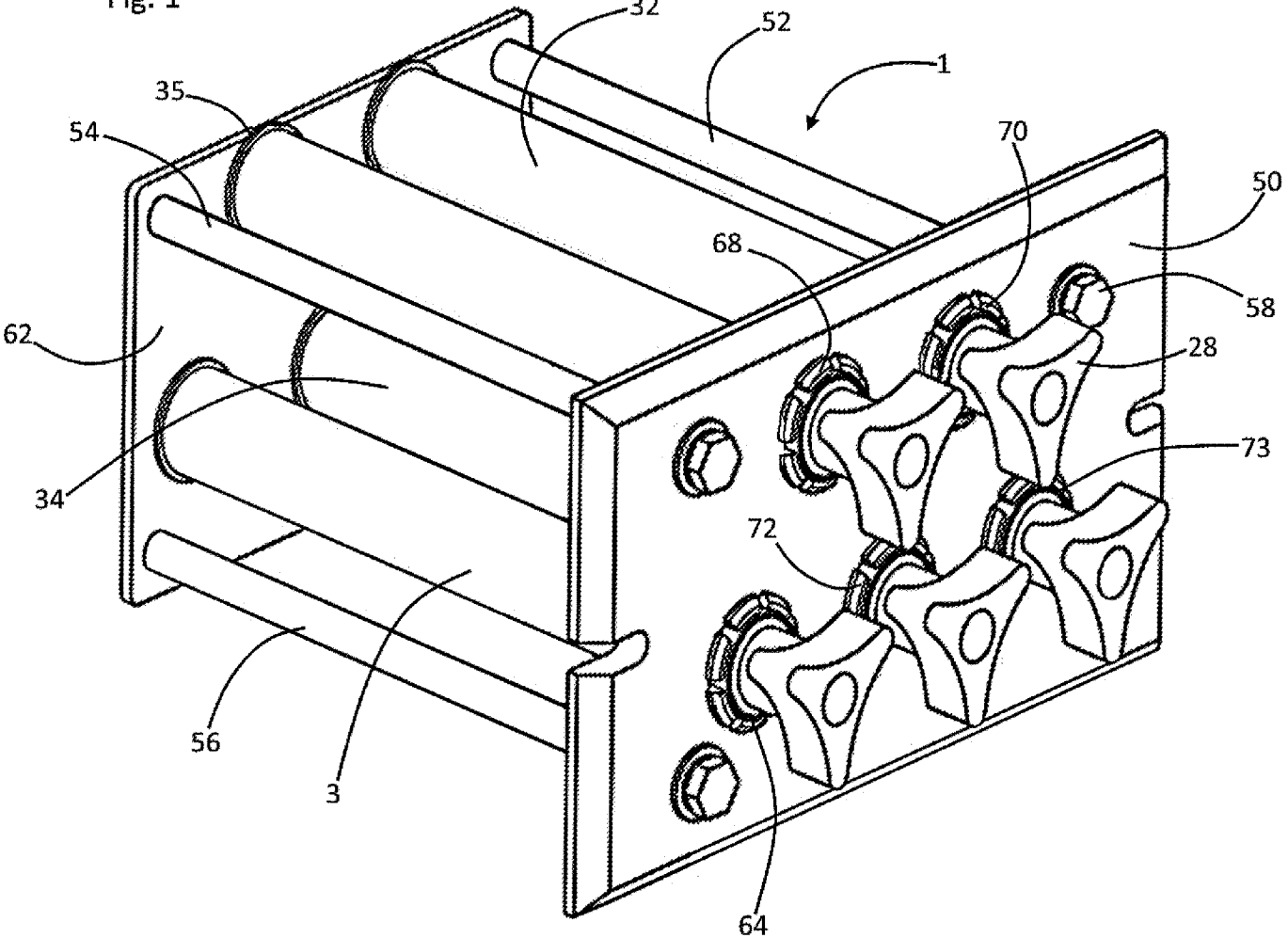
FIG. 1 is a perspective view of a suitable embodiment of the instant inventive magnetic drawer separator.

Referring now to the drawings and in particular to Drawing FIGS. 1-5, a suitable embodiment of the instant inventive magnetic drawer separator is referred to generally by Reference Arrow 1.

Figure 4:
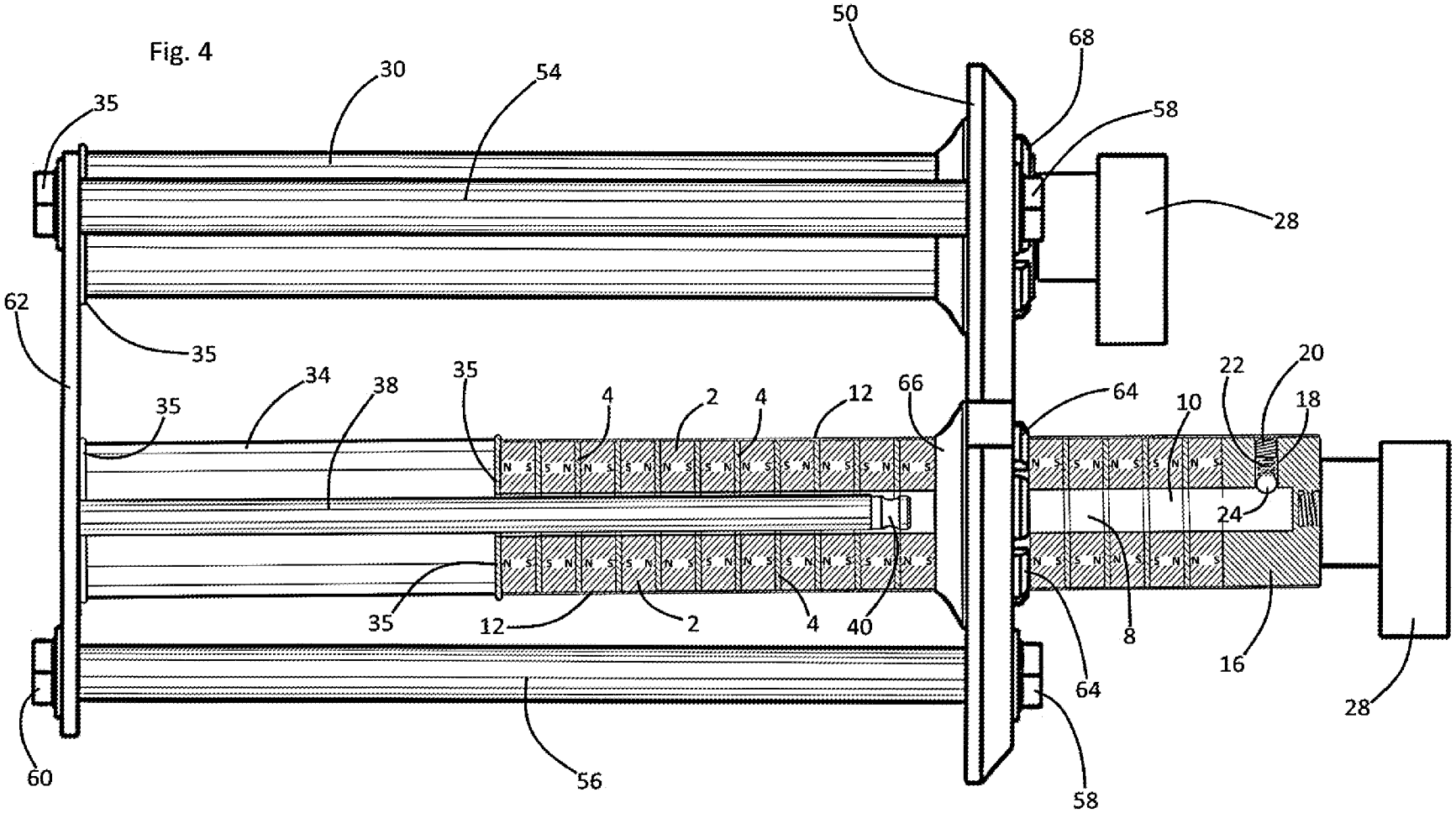
FIG. 4 redepicts the structure of FIG. 2, the view of FIG. 4 showing a magnetic quill component slidably forwardly withdrawn, and showing that element in sectional view as indicated in FIG. 3.

The magnetic drawer separator 1 comprises at least a first series of permanent magnets 2. Each permanent magnet 2 is preferably ring configured having a front or longitudinal end (rightward according to the view of FIG. 2), a rear or oppositely longitudinal end, and an annular outer end. As shown in FIG. 4, each of the permanent magnets has a central opening 8 which, in series with the central openings 8 of other permanent magnets 2 within the series, forms a longitudinally extending hollow bore or void 10. The series of permanent magnets 2 constitutes and functions as a quill component of a telescoping quill and stem combination.

In order to enhance magnetic field strength at the annular outer ends of the permanent magnets 2, such magnets are preferably arranged in a " . . . N, N, S, S, N, N, S, S, . . . " polar series. In such arrangement of magnetic poles, each permanent magnet's north pole faces the north pole of an adjacent permanent magnet, and said each permanent magnet's south pole faces the south pole of an oppositely adjacent permanent magnetic. In order to further enhance the strength of the magnetic fields 5 at the outer surfaces of the quills, ring configured pole pieces 4 are interposed between adjacent pairs of the permanent magnets. Such pole pieces are preferably composed of a paramagnetic material such as mild steel. Epoxy bonds suitably hold the ring components in series.

In order to provide a smooth and screedable surface upon which scraps of ferrous debris or tramp iron may collect, a thin tubular veneers 12 outwardly cover each series of permanent magnets. In order to prevent undesirable magnetic armaturing of the permanent magnets' annular poles at their outer ends, the tube configured veneers 12 are preferably composed of a non-magnetic material such as stainless steel.

A further structural component of the instant inventive magnetic drawer separator comprises at least a first support shaft 38 having a front or longitudinal end which is rightward according to the view of FIG. 4. Support shafts 38, 42, 44, 46, and 48 constitute stem components of telescoping quill and stem combinations 3 and 38, 30 and 42, 32 and 44, 34 and 46, 36 and 48. The at least first support shaft or stem 38 of quill and stem combination 3 is forwardly received within the rearwardly or oppositely axially opening of hollow bore or void 10 of magnetic quill 2,4,12, the other quill and stem combinations 30, 32, 34, and 36 being similarly configured.

Figure 7:
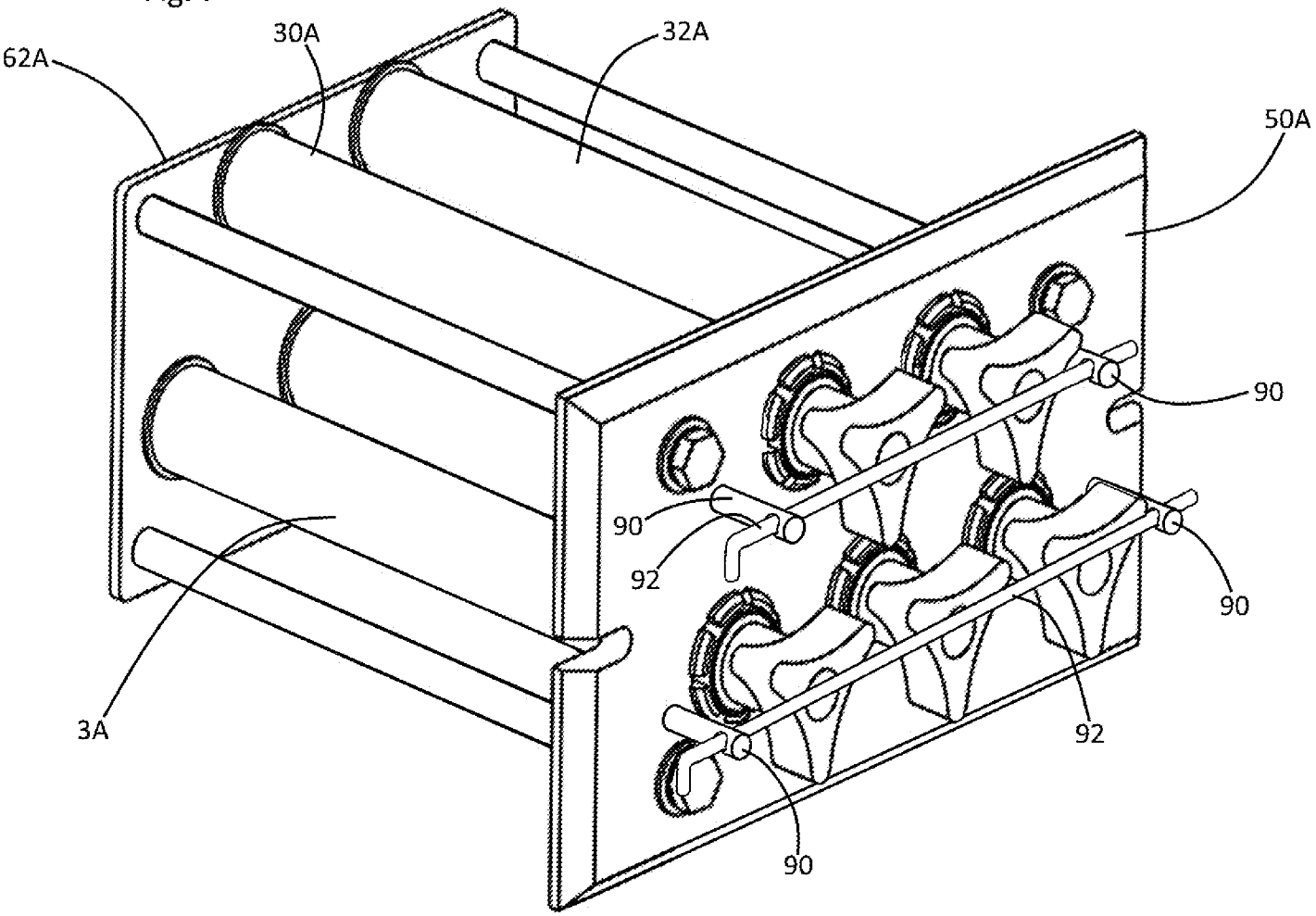
FIG. 7 presents an alternative configuration of the structure depicted in FIG. 1.

Upon full receipt of shaft 38 within the hollow bore 10, a spring biased ball 24 may radially inwardly deflect into an annular channel 40 formed at the front or longitudinal end of the support shaft 38. In order to support and deploy such ball 24, a spring biasing and screw receiving channel 18 may extend radially through a front end segment 16, such channel 18 receiving a spring 22 and a helically threaded set screw 20. Engagements of such spring biased balls 24 within the stems' distal end channels 40 assist in resisting longitudinal movement of the cartridges' quill components during operation of the drawer separator. In the alternative configuration of FIG. 7, retainer bars 92 mounted upon posts 90 may be provided to hold the magnetic quills at their oppositely longitudinally extended positions. Attachable and releasable magnetic bracket plates (not shown in views) may suitably be alternatively provided for securing the quills at their extended magnetic separating positions.

Figure 5:
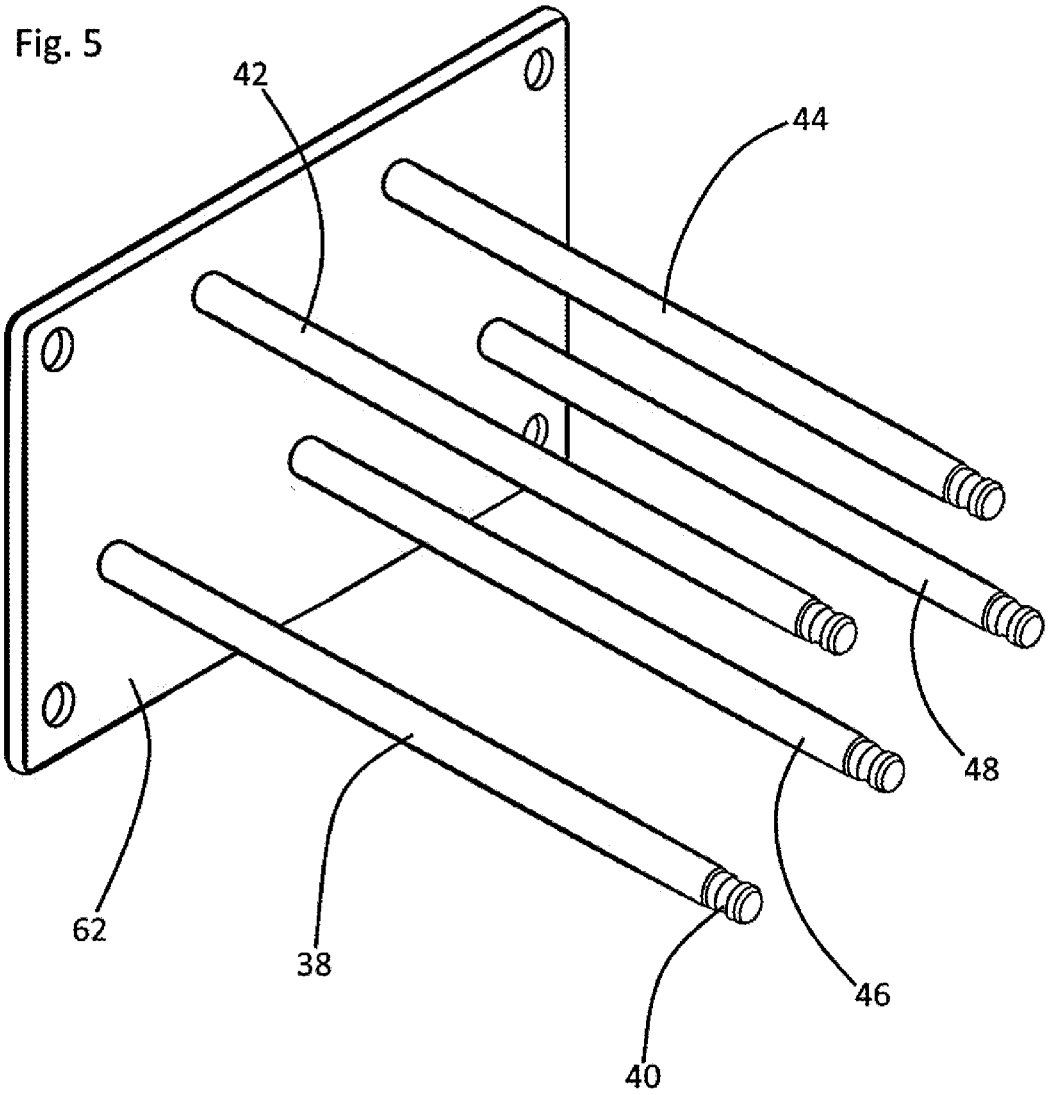
FIG. 5 is a disassembled view of a rear plate and cantilevering support shafts or stems assembly.

Each support shaft 38, 42, 44, 46, and 48 constitutes a stem component of a quill and stem combination, each such shaft preferably having its proximal or oppositely longitudinal end fixedly attached to the oppositely longitudinal end of a drawer frame. As shown in FIG. 5, such frame end is suitably configured as a plate 62, each of the stem or support shafts 38, 42, 44, 46, and 48 cantilevering forwardly or longitudinally therefrom. The distal or longitudinal ends of the shafts 38, 42, 44, 46, and 48 which include the channels 40 are preferably composed of a non-magnetic material such as nickel finished stainless steel, and in a preferred embodiment, the entire lengths of such shafts are non-magnetic.

The drawer frame preferably further comprises a front or longitudinal plate 50 which is rigidly connected to the frame's rear plate 62 by a plurality of tie bars 51, 52, 54, and 56. Bolts 58 secure the plates 50 and 62 upon the longitudinal and oppositely longitudinal ends of such tie bars.

Figure 8:
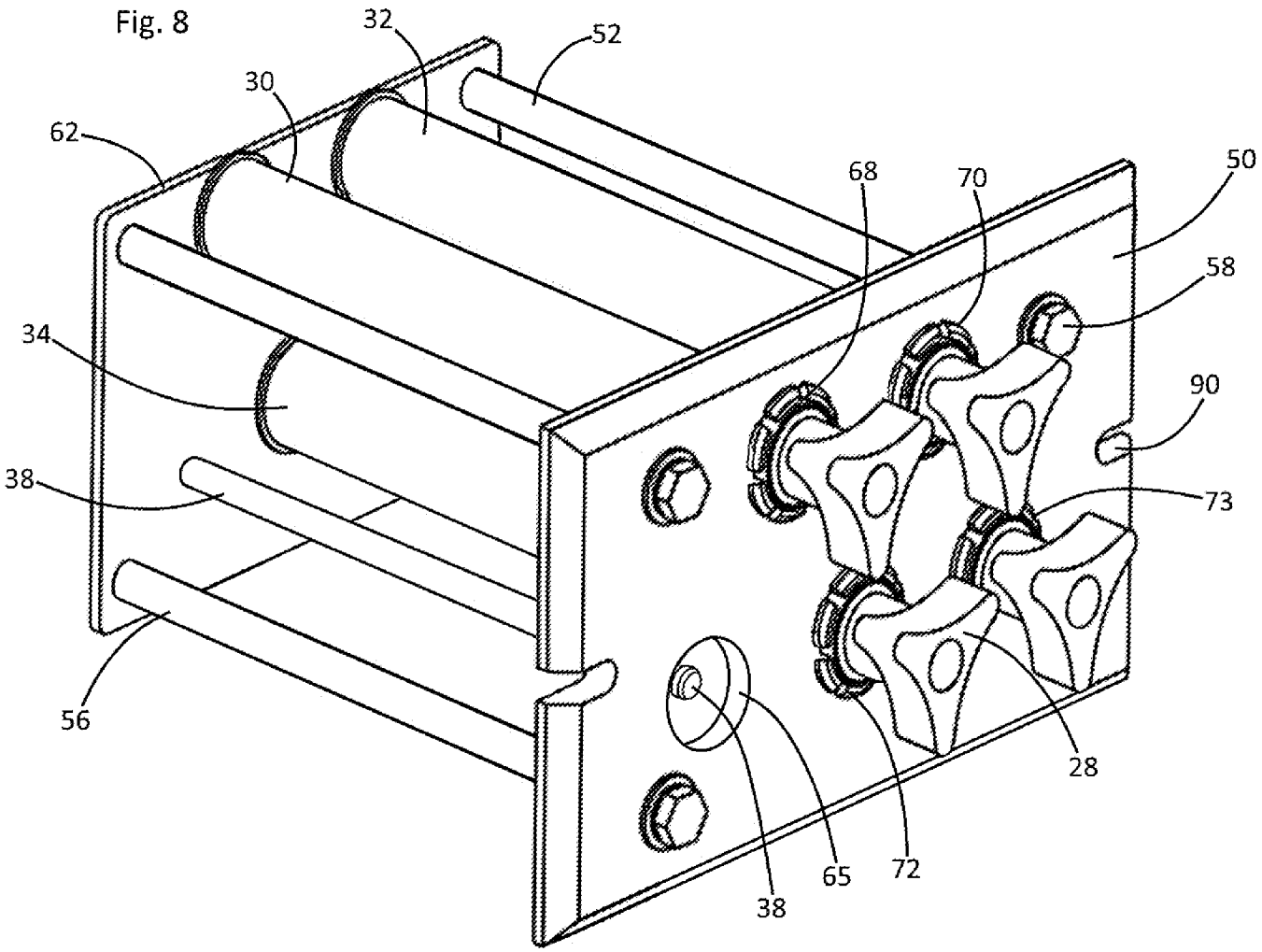
FIG. 8 redepicts the structure of FIG. 1, the view of FIG. 8, showing disassembly and removals of one of the assembly's quill components and one of the assembly's wiper ring components.

Referring to FIG. 8, a plurality of wiper ring receiving apertures 65 extend through the front plate 50. Referring further to FIG. 4, the aperture 65 which is exposed in the view of FIG. 8 receives a wiper ring 64 which has a circumferential array of spring hooks which engage the peripheral front edge of aperture 65. The rearward or oppositely longitudinal end of the wiper ring 64 forms an annular surface wiping screed 66. Each of the wiper rings 64, 68, 70, 72, and 73 is mounted within one of the apertures 65 within front plate 52, and the wiper rings are configured substantially identically with each other. The wiper rings 64, 68, 70, 72, and 73 are preferably composed of durable plastic and their inside diameters are preferably substantially equal to the outside diameters of the cartridges 3, 30, 32, 34, and 36.

Pull handles 28 are preferably mounted to the longitudinal ends of the quill components of the cartridges 3, 30, 32, 34, and 36, such handles allowing the quills to be individually and successively pulled through the wiper rings 64, 68, 70, 72, and 73. The instant invention's provision of individually pullable handles and quills allows each of the wiper rings to exert a high level of surface wiping friction without exceeding a pulling force which an operator may comfortably manually apply to a single pull handle.

While the screeds 66 of the wipers 64, 68, 70, 72, 73 may suitably directly wipe the annular outer surfaces of the permanent magnets 2 and pole pieces 4, thin outer veneers 12 are preferably provided at the exteriors of the quill components. Such veneers 12 provide smooth surfaces for performances of tramp iron screeding. In order to minimize reductions of the strength of the magnetic fields 5, the veneers 12 are preferably thin. The veneers 12 are preferably non-magnetic to prevent magnetic armaturing at the radially outer poles of the permanent magnets 2. In a preferred embodiment, the thin veneers 12 are composed of non-magnetic stainless steel.

Figure 6:
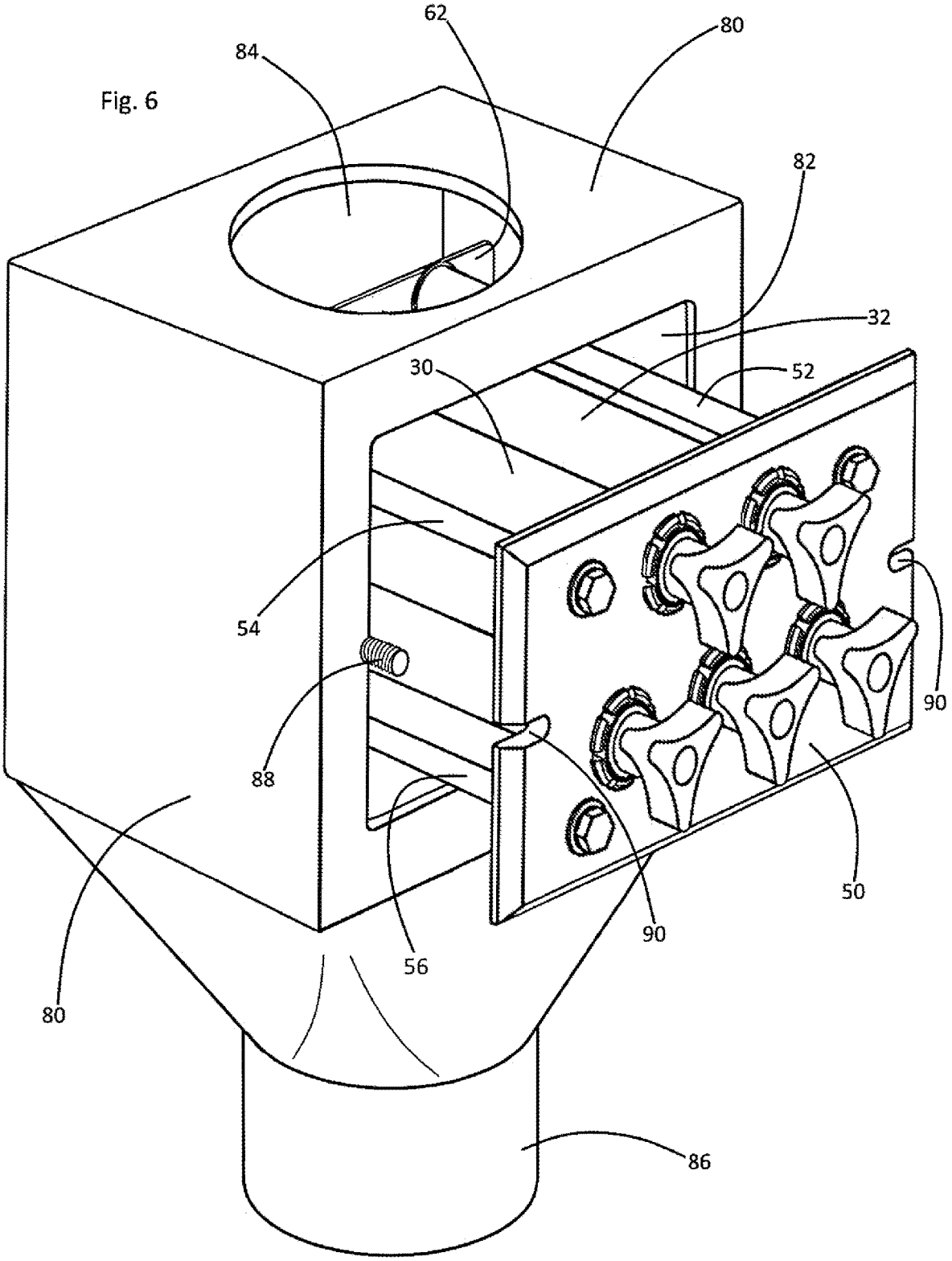
FIG. 6 redepicts the structure of FIG. 1, the view of FIG. 6 showing the drawer structure of FIG. 1 received within a materials flow conduit.

Referring to FIG. 6, the instant inventive magnetic drawer separator preferably further comprises a materials flow conveying conduit 80 having an upper input opening 84 and a lower output opening 86. A drawer receiving port or aperture 82 opens the conduit 80 at its side wall, such aperture 82 being fitted and sized for receipt of drawer frame components 51, 52, 54, 56, and 62. The frame's front plate 50 is preferably sized to forwardly close the aperture 82. Upon such closure, threaded lugs 88 may be received within slots 90. Manualable turnable nuts (not depicted within views) engage such lugs 88 to hold the drawer at its inwardly extended and closed position.

Figure 2:
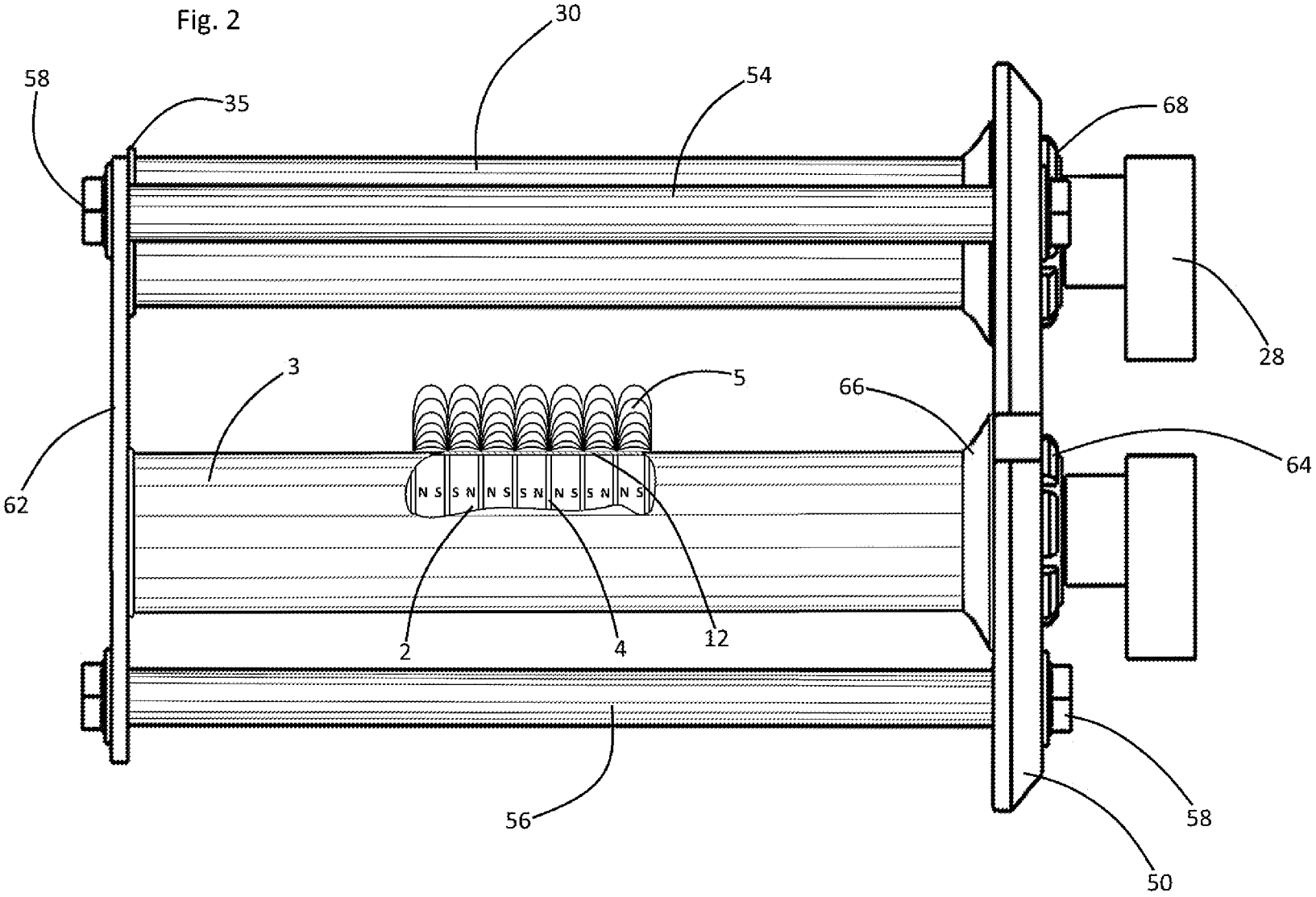
FIG. 2 is a side view of the structure of FIG. 1, the view of FIG. 2 including a cutaway section exposing interior magnets.
Figure 3:
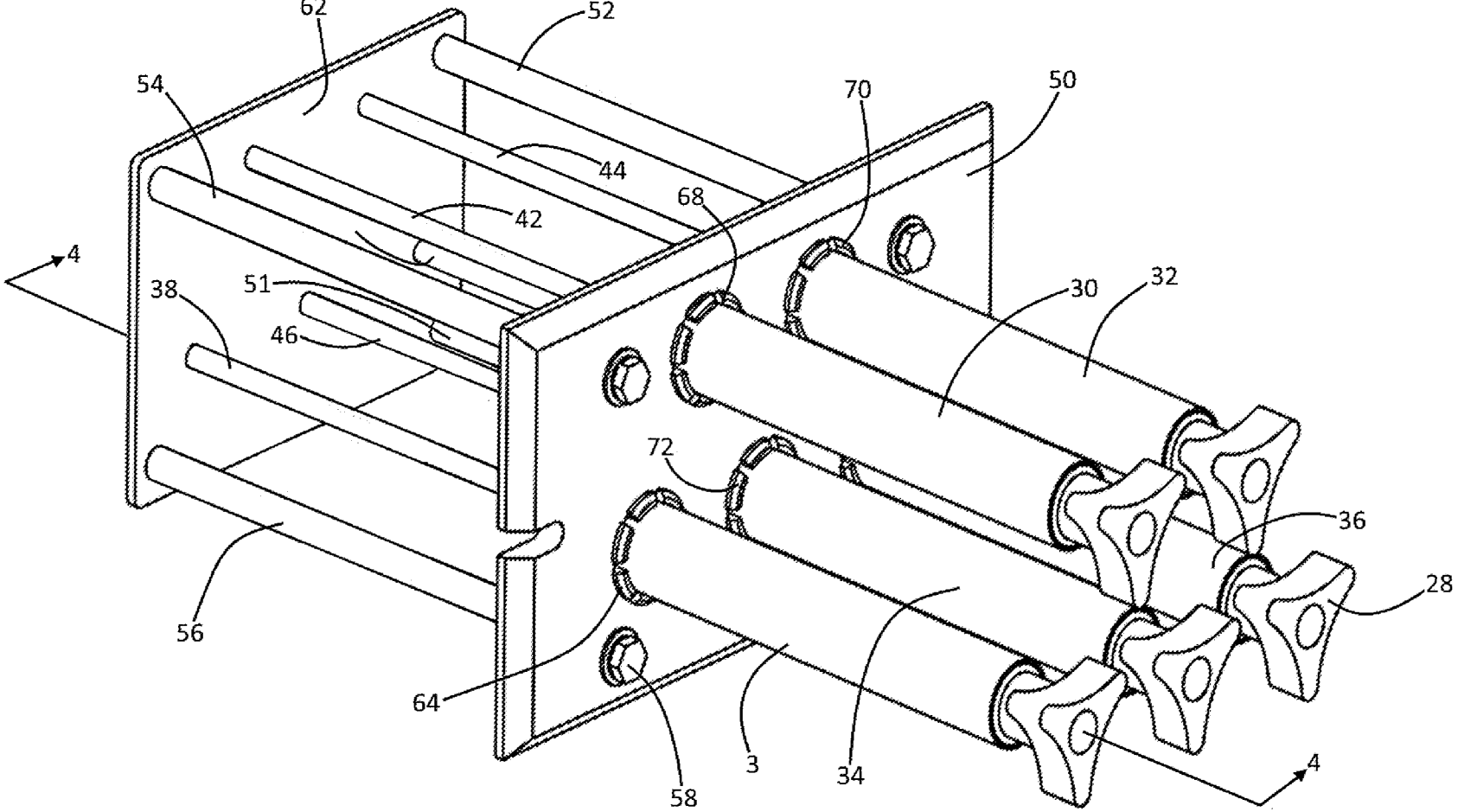
FIG. 3 redepicts the structure of FIG. 1, the view of FIG. 3 alternatively showing magnetic quill components forwardly slidably retracted.

In use and operation of the instant inventive magnetic drawer separator, the drawer component may be initially configured as depicted in FIGS. 1 and 2. In such configuration, spring biased balls 24 extend into to annular channels 40 at the distal ends of stem shafts 38, 42, 44, 46, and 48, such balls holding the quill components of cartridges 3, 30, 32, 34, and 36 at their oppositely longitudinally extended magnetic separating positions.

Thereafter, the operator may insert the oppositely longitudinally extending components 51,52,54,56,62 of the drawer frame into the conduit's drawer aperture 82, and may secure the front plate 50 in place over such aperture utilizing threaded lugs 88.

Upon such insertion, the drawer frame and its matrix of magnetic cartridges extends rearwardly across the interior space or vertical channel of the conduit 80.

Thereafter, a flow of materials such as grain or extrusion molding plastic pellets may be introduced into the conduit to flow downwardly therethrough. As such materials flow through and around the magnetic cartridges, tramp iron contaminants within the materials flow magnetically adheres to the magnetic cartridges.

During such materials flow, the proximal ends of the cantilevering stems 38, 42, 44, 46, and 48 mechanically support the oppositely longitudinal ends of the quill components of cartridges 3, 30, 32, 34, and 36. The wiper rings 64, 68, 70, 72, and 73 mounted within apertures 65 within the frame's front plate 50 correspondingly mechanically support the longitudinal ends of the quills.

Following prolonged magnetic separating use of the drawer separator, tramp iron accumulations within the separator may threaten to become dislodged and separated from the magnetic cartridges, undesirably falling downwardly with the materials flow. Prior to such excess tramp iron accumulation, the drawer is preferably removed by an operator from the conduit 80. Thereafter, the operator may successively pull forwardly upon the handles 28, causing the drawer to assume the FIG. 3 configuration. Individual pulls against the pull handles 28 may continue until annular extraction stops 35 at the oppositely longitudinal ends of the cartridges 3, 30, 32, 34, 36 contact the annular screeds 66 of the wiper rings 64, 68, 70, 72, and 73.

As forward extractions of the magnetic quills progress, tramp iron accumulated along the lengths of the magnetic quills is advantageously screeded by the wiper rings toward the quills' oppositely longitudinally ends. The rearwardly screeded tramp iron accumulations then downwardly fall from the oppositely longitudinal ends of the quills. Accordingly, the wiper rings 64,68,70,72,73 contribute to the instant invention's performance of a magnetic release function. The screeded tramp iron falls over or across the forward or distal ends of stems 38,42,44,46,48, such stems' non-magnetic character allowing substantially all of the tramp iron to freely fall downwardly into a collection bin (not depicted within views). The non-magnetic character of the stems assists in the instant invention's performance of the magnetic release function.

A reversal of usages steps described above reconfigures the assembly for magnetic separating use.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A magnetic drawer separator comprising:
(a) a frame having longitudinal and oppositely longitudinal ends;
(b) a first permanent magnet series supported within the frame, said series having a longitudinal end, an oppositely longitudinal end, and an outer end, wherein each of said series's permanent magnets has an opening;
(c) a longitudinally extending void formed by the permanent magnets' openings;
(d) a first shaft fixedly attached to and extending longitudinally from the frame's oppositely longitudinal end, the first shaft being received within the longitudinally extending void; and
(e) a first wiper fixedly attached to the frame's longitudinal end, the first wiper engaging the outer end of the first permanent magnet series.

2. The magnetic drawer separator of claim 1 further comprising:
(a) at least a second permanent magnet series;
(b) at least a second shaft fixedly attached to the frame, the at least second shaft supporting the at least second permanent magnet series; and
(c) at least a second wiper fixedly attached to the frame, the at least second wiper engaging the at least second permanent magnet series.

3. The magnetic drawer separator of claim 2 wherein each shaft is composed of non-magnetic material.

4. The magnetic drawer separator of claim 3 wherein each magnet among the series of permanent magnets is ring configured.

5. The magnetic drawer separator of claim 4 wherein said each magnet among the series of permanent magnets has a north pole and a south pole, wherein said each magnet's north pole faces an adjacent magnet's north pole, and wherein said each magnet's south pole faces an oppositely adjacent magnet's south pole.

6. The magnetic drawer separator of claim 5 further comprising a plurality of pole pieces, each pole piece residing between an adjacent pair of the permanent magnets.

7. The magnetic drawer separator of claim 6 wherein each pole piece is ring configured and is composed of paramagnetic material.

8. The magnetic drawer separator of claim 5 wherein the outer end of each permanent magnet series comprises a non-magnetic veneer.

9. The magnetic drawer separator of claim 8 wherein each non-magnetic veneer is cylindrical and has an outside diameter, wherein each wiper has an inside diameter, and wherein said outside and inside diameters are substantially equal to each other.

10. The magnetic drawer separator of claim 9 wherein the longitudinal end of the frame comprises a plate having a plurality of apertures, and wherein each wiper is supported within one of the apertures.

11. The magnetic drawer separator of claim 10 wherein the oppositely longitudinal end of the frame comprises another plate, and wherein each shaft cantilevers therefrom toward one of the apertures.

12. The magnetic drawer separator of claim 11 wherein the frame comprises a plurality of tie bars interconnecting the plates.

13. The magnetic drawer separator of claim 12 further comprising a plurality of handles, each handle being fixedly attached to a longitudinal end of one of the permanent magnet series.

14. The magnetic drawer separator of claim 13 further comprising a conduit having a wall and a port opening the conduit at the wall, the port being fitted for receiving the frame.

15. A magnetic separator comprising:

(a) a first quill and stem combination whose quill is magnetic, and whose stem is non-magnetic;

(b) a drawer frame having longitudinal and oppositely longitudinal ends, the non-magnetic stem being fixedly attached to and cantilevering longitudinally from the drawer frame's oppositely longitudinal end; and (c) a first wiper ring annularly engaging the magnetic quill, said wiper ring being fixedly attached to said frame's longitudinal end.

16. The magnetic separator of claim 15 further comprising at least a second quill and stem combination whose stem is fixedly attached to the frame's oppositely longitudinal end, and at least a second wiper ring annularly engaging said second combination's quill, the at least second wiper ring being fixedly attached to the drawer frame's longitudinal end.

17. The magnetic separator of claim 16 wherein each of the quill and stem combinations' quills comprises a series of magnetic rings having a " . . . N, N, S, S, N, N, S, S . . . " arrangement of magnetic poles.

18. The magnetic separator of claim 17 wherein each of the quill and stem combinations' quills comprises a plurality of pole pieces, each pole piece residing between an adjacent pair of the magnetic rings.

19. The magnetic separator of claim 18 wherein each pole piece is ring configured and is composed of paramagnetic material.

20. The magnetic separator of claim 19 further comprising a conduit having a side wall and a port opening the conduit at the side wall, the port being fitted for receiving the drawer frame.

* * * * *